US005777256A

United States Patent [19]

Simon et al.

[11] Patent Number: 5,777,256

[45] Date of Patent: Jul. 7, 1998

[54] SEALING DEVICE FOR A WEAPON FIRING CASELESS AMMUNITION

[75] Inventors: Françoise Simon, Plaimpied; Franck Bouvard, Bourges, both of France

[73] Assignee: Giat Industries, Versailles, France

[21] Appl. No.: 848,752

[22] Filed: May 1, 1997

Related U.S. Application Data

[63] Continuation of Ser. No. 568,502, Dec. 7, 1995, abandoned.

[30] Foreign Application Priority Data

Dec. 12, 1994 [FR] France ..... 94 14911

[51] Int. Cl.[6] ..... F41A 3/76

[52] U.S. Cl. ..... 89/26; 42/16

[58] Field of Search ..... 89/26; 42/16

[56] References Cited

U.S. PATENT DOCUMENTS

| | | | |
|---|---|---|---|
| 3,006,254 | 10/1961 | Thierry | 89/26 |
| 3,159,938 | 12/1964 | Treat et al. | 42/59 |
| 3,613,500 | 10/1971 | Warin | 89/26 |
| 3,626,620 | 12/1971 | Rocha | 42/15 |
| 3,645,166 | 2/1972 | Plumev et al. | 89/26 |
| 3,762,328 | 10/1973 | Rocha . | |
| 3,799,560 | 3/1974 | Stearns et al. | 277/212 |
| 4,022,104 | 5/1977 | Politzev et al. | 42/16 |
| 5,487,232 | 1/1996 | Osbourne et al. | 42/51 |

FOREIGN PATENT DOCUMENTS

| | | | |
|---|---|---|---|
| 0251902 | 1/1988 | European Pat. Off. . | |
| 1157474 | 5/1958 | France . | |
| 687826 | 2/1953 | United Kingdom . | |
| 2233747 | 1/1991 | United Kingdom | 89/26 |

OTHER PUBLICATIONS

A. Merriam Webster, Webster's Ninth Collegiate Dictionary, 1985, pp. 121 and 970.

*Primary Examiner*—Stephen M. Johnson
*Attorney, Agent, or Firm*—Oliff & Berridge, PLC

[57] ABSTRACT

A sealing device for sealing the combustive gases of a caseless munition is mounted between a barrel and a firing chamber of a small caliber weapon. The sealing device includes a ring-shaped sealing element with a first end forming a radially extending sealing surface structured to press against the rear face of the barrel, and a second end includes an outwardly facing axially extending lip designed to press against an inner wall of the firing chamber. A cooling element reduces the rise in temperature of the sealing element, which comes into contact with the combustive gases.

18 Claims, 3 Drawing Sheets

SEALING DEVICE FOR A WEAPON FIRING CASELESS AMMUNITION

This is a Continuation of Application Ser. No. 08/568,502 filed Dec. 7, 1995 now abandoned.

BACKGROUND OF THE INVENTION

The technical scope of the present invention is that small caliber weapons firing caseless ammunition.

In conventional weapons, i.e., weapons firing cased ammunition, the problem of the sealing between the barrel and the breech block does not arise given that it is the case itself which provides this sealing directly by expanding (plastic deformation) under the action of the combustive gas pressure produced by the propellant charge. The case, made of metal or of a plastic material, is flattened against the chamber wall prolonging the barrel. It is known that in a small caliber military weapon, the pressure generated in the chamber is somewhere in the region of $5.10^7$ Pa and the instant temperature of the gas is around 2500° C.

Using caseless or combustible case ammunition makes it necessary to have a sealing device for the breech block and the barrel.

SUMMARY OF THE INVENTION

One object of the present invention is thus to provide a sealing device for the combustive gases of a caseless munition which ensures sealing for an instant temperature of somewhere in the region of 2500° C and a pressure of around $5.10^7$ Pa.

A further object of the present invention is to propose a sealing device, the cooling of which reduces the rise in temperature for bursts of fire of around 150 rounds per minute.

The subject of the invention is thus a sealing device for the combustive gases of a caseless munition, mounted between the barrel and the firing chamber of a small caliber weapon, characterized in that it comprises a seal which includes:

a ring-shaped sealing element, wherein one end face forms an axial sealing surface designed to press against the rear face of the barrel, and which is fitted with a radial sealing lip on its other end designed to press against the inner wall of the firing chamber, and a cooling element to reduce the rise in temperature of the sealing element of the seal which comes into contact with the combustive gases.

According to another characteristic of the invention, the seal is fastened in a floating manner between the barrel and the breech block so as to be able to move axially under the effect of the combustive gas pressure.

According to one embodiment, the cooling element of the seal is ring-shaped, coaxial to the outside of the sealing element of the seal and connected to the seal's periphery by a ring-shaped radial wall.

According to a further characteristic of the invention, the axial position of the wall connecting the two parts of the seal is such that, on the barrel side, the sealing element, the cooling element and the connecting wall of the seal demarcate between each other a decompression cavity for the combustive gases.

In a general manner, the cooling element of the seal is designed to be housed in a ring-shaped space defined between the rear element of the barrel and the breech block, and is used to ensure the floating fastening of the seal.

In a general manner, the cooling element of the seal is fastened to the breech block by at least one to connector which engages freely in an oblong opening arranged in the wall of the sealing element of the seal. The connector for example, is a screw whose head is locked by the breech block and whose shaft engages in the aforementioned opening.

Lastly, according to yet another characteristic of the invention, the two sealing and cooling elements which make up the seal form a single part which is made of a spring steel, for example.

One advantage of the sealing device according to the invention lies in the fact that the sealing is ensured by a single-part device which facilitates its manufacture and its assembly in the weapon and afterwards its replacement in the event of deterioration.

Another advantage lies in the use of the combustive gas pressure to ensure the movement of the sealing device and its deformation.

BRIEF DESCRIPTION OF THE DRAWINGS

Other characteristics, advantages and details of the invention will become apparent from reading the additional descriptions given hereafter by way of illustration of preferred embodiments with reference to the drawings in which.

DETAILED DESCRIPTION OF PREFERRED EMBODIMENTS

Figure 1:
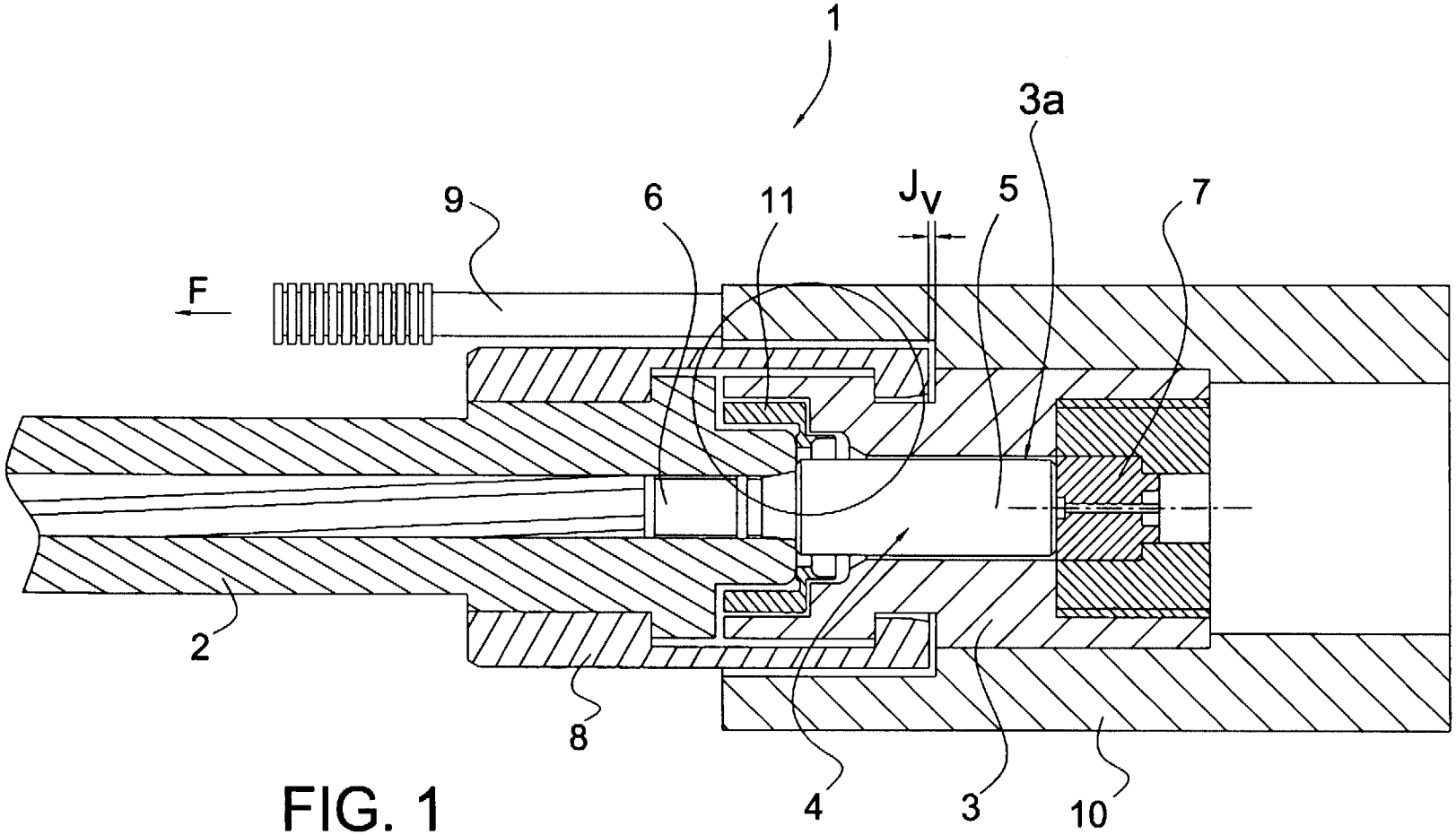
FIG. 1 is a element longitudinal section view of a weapon.

The weapon 1 partly shown in a longitudinal section in FIG. 1 comprises a barrel 2 aligned with a breech block 3 in whose chamber 3*a* a caseless munition 4 is housed which is made up of a propellant charge 5 and a projectile 6 engaged in the barrel. The munition 4 is fired by means of an electrical or percussion initiating device 7. The barrel 2 and the breech 3 are fastened to one another by means of a cylinder lock 8. The breech block 3 is subjected to the action of a counter recoil spring 9 which applies an axial force F to the breech block 3.

Figure 2:
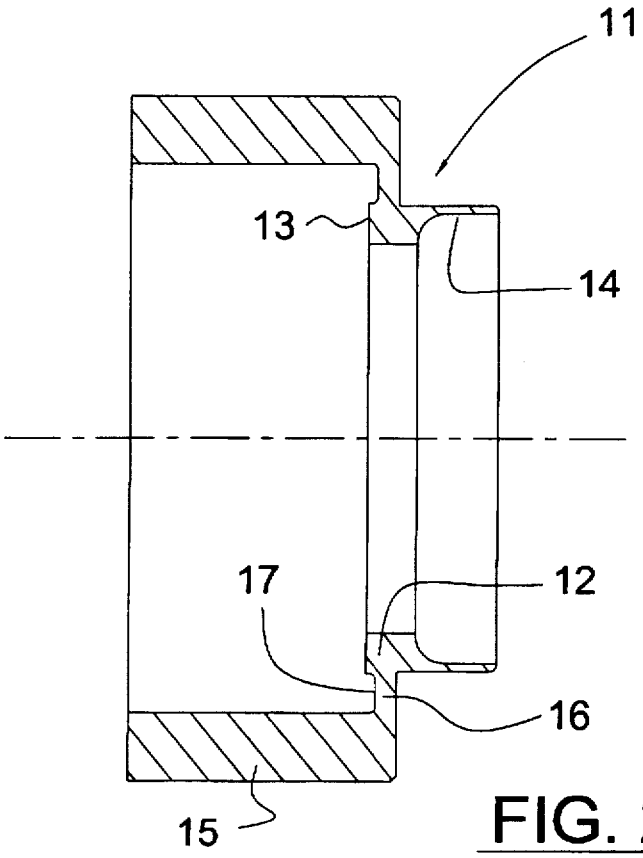
FIG. 2 is a section view of the sealing device according to the invention.

Between the barrel 2 and the breech block 3, sealing for the combustive gases produced by the detonating propellant charge 5 is ensured according to the invention by a seal 11 shown in FIG. 2 and described herebelow.

The seal 11 comprises :

a ring-shaped sealing element 12, wherein the end face forms a radially extending sealing surface 13 designed to press against the rear face 2*a* of the barrel 2, and which comprises an outwardly facing, axially extending lip surface 14 towards its other end designed to press against an axially extending inner wall of the chamber 3*a*, and a cooling element 15 designed to reduce the rise in temperature of the sealing element 12 which comes into contact with the combustive gases.

The cooling element 15 of the seal 11 is ring-shaped, externally coaxial to the sealing element 12 and connected to the latter's periphery by a radial ring-shaped wall 16. The axial position of the connecting wall 16 is such that, on the barrel side, the sealing element 12, the cooling element 15 and the connecting wall 16 demarcate between themselves a compression cavity 17 for the combustive gases. In the example shown, the cooling element 15 extends on one side of the connecting wall 16 and towards the barrel 2.

The seal 11 is made from a material which may be elastically deformed having high thermo-mechanical properties and a wide operating temperature range, between 50°0 and 450° C., this material being, for example, a spring steel.

By way of example, the sealing element 12 of the seal 11 has an outer diameter of somewhere in the region of 13mm, extends for a length of 5.5mm, the lip being around 0.4mm thick, the cooling element 15 extends for a length of around 9mm and is around 3.7mm thick, and the decompression cavity is around 2.5mm wide.

In a general manner, the cooling element 15 extends axially for a length which is greater than that of the sealing element 12, such as to allow the seal 11 to cool down by reducing the rise in temperature of the sealing element 12 which comes into direct contact with the combustive gases, such that its temperature remains under the annealing temperature of the steel of which it is made up.

Figure 3:
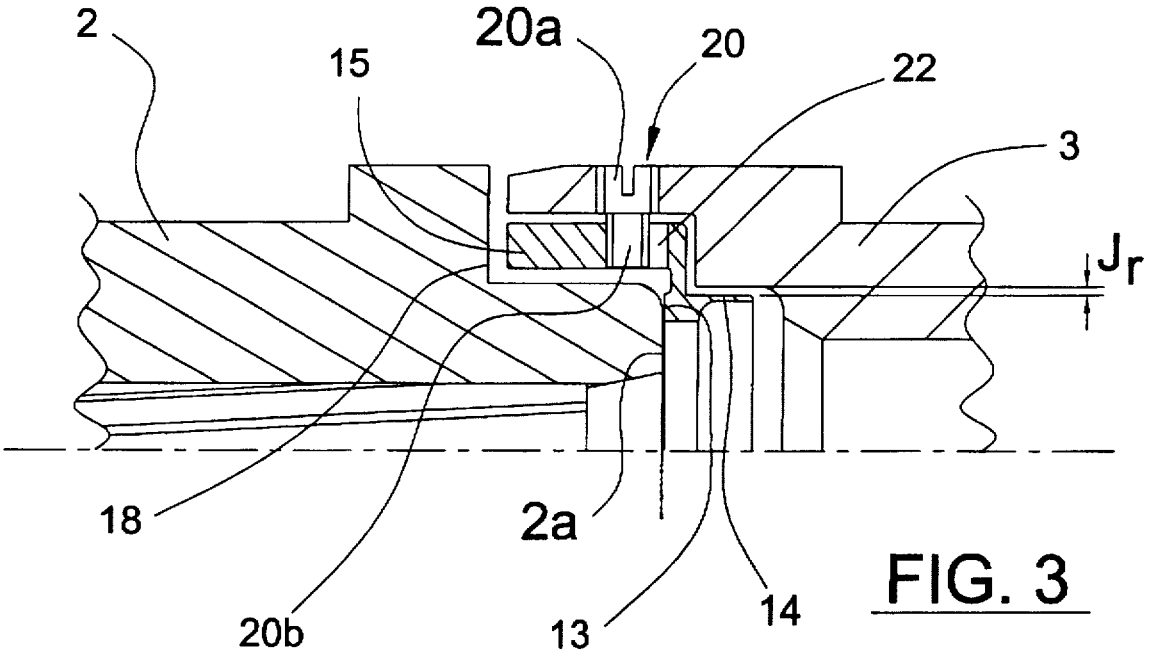
FIGS. 3 to 5 are element section views illustrating the operation.

With reference to FIG. 3, the cooling element 15 of the seal 11 is designed to be housed in a ring-shaped space 18 defined between the rear element of the barrel 2 and the breech block 3. The seal 11 is designed to be mounted pretightened between the barrel 2 and the breech block 3 on the one hand, and fastened in a floating manner to be able to move axially under the effect of the combustive gases on the other. The floating mounting of the seal 11 guarantees its position between the barrel 2 and the breech 3 block during pressure build-up in the chamber 3*a*.

In FIG. 3, the seal 11 is fastened to the breech block 3 by at least one connecting means 20 freely engaging inside an oblong opening 22 arranged in the wall of the cooling element 15 of the seal 11. This connecting means 20 is, for example, constituted by a screw, wherein the head 20*a* is locked in the breech block 3, whereas its shaft 20*b* freely engages into the opening 22. Three screws 20 may, for example, be provided evenly distributed around the cooling element 15 of the seal 11. The seal 11 is mounted pretightened between the barrel 2 and the breech block 3 under the effect of the counter recoil spring 9 which acts on the breech block 3 such that its radially extending sealing surface 13 presses against the rear face 2*a* of the barrel 2 but with a minimum radial clearance Jr between the outwardly facing, axially extending lip 14 and the axially extending inner wall of the chamber 3*a*.

Figure 4:
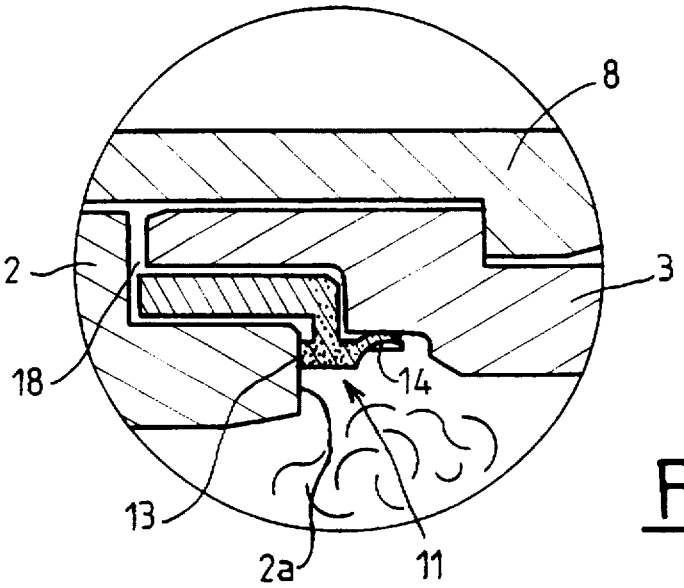

In operational conditions, the elastic deformation of the seal 11 will enable it to be closely applied, under the effect of the combustive gas pressure, against the barrel 2 by the axial flattening of the surface 13 of the sealing element 12 and against the chamber 3*a* by the elastic deformation of the lip 14. More specifically, after ignition of the propellant charge 5, the pressure builds up in the chamber 3*a* and the seal 11 moves in two successive phases from its starting position shown in FIG. 3. When the round is first fired, as shown in FIG. 4, the pressure goes from a value of P0 of $4.10^7$ Pa, known as the flattening pressure, from which the radial clearance Jr of the seal 11 when mounted in the chamber 3*a* is eliminated by elastic deformation of the lip 14 which is flattened against the inner wall of the chamber 3*a*. The axial resultant of the pressure forces also flattens the surface 13 of the seal 11 against the rear face 2*a* of the barrel thus absorbing the locking backlash elimination Jv between the breech block 3 and the barrel 2. The chamber 3*a* is thus rendered perfectly gastight as soon as this pressure value is reached.

Figure 5:
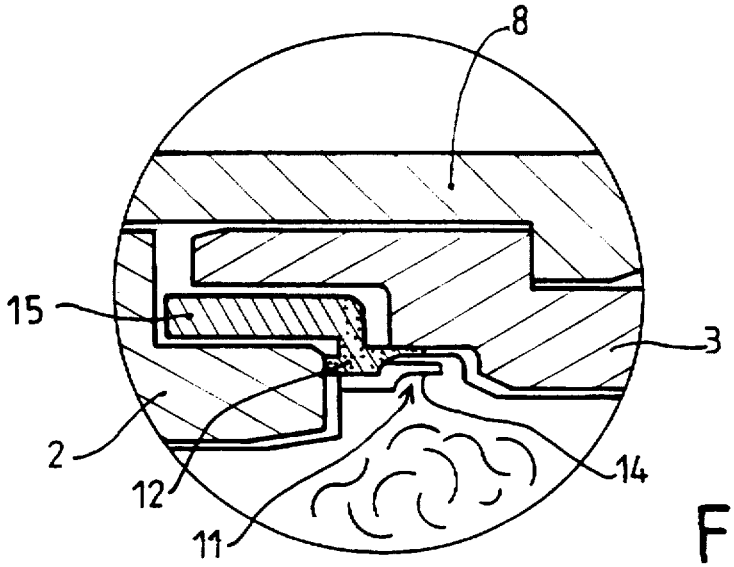

The pressure reaches its maximum value, somewhere in the region of $5.10^7$ Pa, the temperature reaches its maximum value, around 2500° C., and as shown in FIG. 5, the seal 11, the barrel 2 and the breech block 3 deform evenly. The seal 11 slides and ensures the radial and axial sealing by the elastic deformation of the sealing element directly subjected to the effects of the combustive gases.

After firing, the seal 11, the barrel 2 and the breech block 3 recover their respective positions as shown in FIG. 3.

In a general manner, the axial sealing surface of the sealing element 12 of the seal 11 is restricted to a fairly thin crown, as this enables :

the provision of a better contact, with no interruptions whatsoever between the seal 11 and the barrel 2, and thus to be unhindered by any geometrical imperfections, the increase in the contact pressure between the seal 11 and the barrel 2, and thus to reduce the gas infiltration due to surface roughness, and the formation of the decompression cavity 17 which makes any possible gas leaks drop in pressure and velocity thereby braking such leaks.

In a general manner, the fastening of the seal 11 may be envisaged at the rear of the barrel 2, rather than making it integral with the sliding breech block 3.

We claim:

1. A sealing device for sealing combustive gases of a caseless munition, said sealing device being mounted between a barrel and a firing chamber defined by a breech block of a weapon, said sealing device comprising:

a ring-shaped sealing element having a first end defining a radially extending sealing surface for contacting a rear face of the barrel, and a second end having an outwardly facing axially extending lip surface for contacting an axially extending inner wall of the firing chamber;

a cooling element that compensates for thermal expansion of the sealing element upon firing of the combustive gases to reduce a rise in temperature of the sealing element; and a ring-shaped radial connecting wall extending perpendicular to and connecting the ring-shaped sealing element to the cooling element, wherein the cooling element is ring-shaped and coaxial with an axis of the sealing element and wherein the ring-shaped cooling element is located externally of the sealing element.

2. A sealing device according to claim 1, wherein the sealing device is slideably fastened in a floating manner between the barrel and the breech block so as to be axially movable under the effect of the combustive gases.

3. A sealing device according to claim 1, further comprising a decompression cavity for the combustive gases defined between the sealing element, the cooling element and the connecting wall.

4. A sealing device according to claim 1, wherein the cooling element comprises a shape that substantially conforms to a ring-shaped space between the rear face of the barrel and the breech block.

5. A sealing device according to claim 4, wherein the cooling element is fastened to the breech block by at least one connector slideably engaging an oblong opening arranged in a wall of the cooling element.

6. A sealing device according to claim 5, wherein the connector is a screw having a head locked by the breech block and a shaft that engages in the opening of the cooling element.

7. A sealing device according to claim 1, wherein the sealing device comprises an elastically deformable material having high thermo-mechanical properties.

8. A sealing device according to claim 7, wherein the sealing device comprises spring steel.

9. A sealing device according to claim 7, the sealing device is mounted in a pretightened manner between the barrel and breech block.

10. A sealing device for sealing combustive gases of a caseless munition, said sealing device being mounted between a barrel and a firing chamber defined by a breech block of a weapon, said sealing device comprising:

a ring-shaped element having a first end defining a radially extending sealing surface for contacting a rear face of the barrel and a second end, opposite the first end, having an outwardly facing, axially extending lip surface for contacting an axially extending inner wall of the firing chamber;

means for compensating for thermal expansion of the sealing element upon firing of the combustive gases to reduce a rise in temperature of the sealing element; and connecting means extending perpendicular to the sealing element and the means for compensating for connecting a periphery of the sealing element to the means for compensating, wherein the means for compensating is ring-shaped and coaxial with an axis of the sealing element and wherein the means for compensating is located externally of the sealing element.

11. A sealing device mounted between a barrel and a breech block of a weapon, said sealing device comprising:

a sealing element that contacts both a rear face of the barrel and an axially extending inner wall of the breech block; and means for compensating for thermal expansion of the sealing element upon firing of combustive gases to reduce a rise in temperature of the sealing element; and connecting means extending perpendicular to the sealing element and the means for compensating for connecting a periphery of the sealing element to the means for compensating, wherein the means for compensating is ring-shaped and coaxial with an axis of the sealing element and wherein the means for compensating is located externally of the sealing element.

12. A sealing device according to claim 1, wherein the sealing device is slideably fastened in a floating manner between the barrel and the breech block so as to be axially movable under the effect of the combustive gases.

13. A sealing device according to claim 11, wherein the sealing element, the means for compensating and the connecting means define a decompression cavity for the combustive gases.

14. A sealing device according to claim 11, wherein the means for compensating comprises a shape that substantially conforms to a ring-shaped space between the rear face of the barrel and the breech block.

15. A sealing device according to claim 14, wherein the means for compensating includes a cooling element fastened to the breech block by at least one connector slideably engaging an oblong opening arranged in a wall of the cooling element.

16. A sealing device according to claim 15, wherein the connector is a screw having a head locked by the breech block and a shaft that engages in the opening of the cooling element.

17. A sealing device according to claim 11, wherein the dealing device comprises an elastically deformable material having high thermo-mechanical properties.

18. A sealing device according to claim 17, wherein the dealing devices comprises spring steel.

* * * * *